US009007295B2

(12) United States Patent
Kim

(10) Patent No.: US 9,007,295 B2
(45) Date of Patent: Apr. 14, 2015

(54) DYNAMIC CONTRAST RATIO PROCESSING METHOD AND APPARATUS OF LIQUID CRYSTAL DISPLAYING APPARATUS

(75) Inventor: Hyungdae Kim, Beijing (CN)

(73) Assignee: Beijing Boe Optoelectronics Technology Co., Ltd., Beijing (CN)

( * ) Notice: Subject to any disclaimer, the term of this patent is extended or adjusted under 35 U.S.C. 154(b) by 1285 days.

(21) Appl. No.: 12/416,307

(22) Filed: Apr. 1, 2009

(65) Prior Publication Data

US 2009/0251399 A1 Oct. 8, 2009

(30) Foreign Application Priority Data

Apr. 3, 2008 (CN) ..... 2008 1 0103442

(51) Int. Cl.
*G09G 3/36* (2006.01)
*G09G 3/34* (2006.01)

(52) U.S. Cl.
CPC ..... *G09G 3/3406* (2013.01); *G09G 2320/0247* (2013.01); *G09G 2320/064* (2013.01); *G09G 2320/0646* (2013.01); *G09G 2320/0653* (2013.01); *G09G 2340/16* (2013.01); *G09G 2360/16* (2013.01)

(58) Field of Classification Search
USPC ..... 345/87–89, 102
See application file for complete search history.

(56) References Cited

U.S. PATENT DOCUMENTS

| | | | | |
|---|---|---|---|---|
| 7,382,350 | B2 * | 6/2008 | Huang et al. | 345/102 |
| 2008/0030450 | A1 * | 2/2008 | Yamagishi et al. | 345/89 |
| 2008/0043027 | A1 | 2/2008 | Shiomi et al. | |
| 2009/0121990 | A1 | 5/2009 | Shigeta et al. | |

FOREIGN PATENT DOCUMENTS

| | | | |
|---|---|---|---|
| CN | 1828698 | A | 9/2006 |
| WO | 2006/062159 | A1 | 6/2006 |
| WO | 2006/126322 | A1 | 11/2006 |

* cited by examiner

*Primary Examiner* — Kathy Wang-Hurst
*Assistant Examiner* — Jose Soto Lopez
(74) *Attorney, Agent, or Firm* — Ladas & Parry LLP

(57) ABSTRACT

The present invention relates to a dynamic contrast ratio processing method and apparatus of a liquid crystal displaying apparatus. The method includes: performing a histogram statistics processing on input data of the present frame, dividing a statistics processing result into N gray groups, and calculating the a data amount corresponding to each gray group; setting gray groups whose corresponding data amounts are larger than or equal to a first threshold as gray groups with priority, and setting a gray group having the highest luminance in gray groups with priority as a main priority gray group; determining whether the luminance of the main priority gray group of the present frame is the same as that of the main priority gray group of a previous frame; if it is, comparing data amounts with corresponding tolerance values to determine whether it is necessary to change the luminance control parameter, otherwise, obtaining the luminance control parameter of the present frame according to the main priority gray group of the present frame; outputting the luminance control parameter of the present frame at last. The present invention improves flickering phenomenon effectively and enhances picture quality.

11 Claims, 4 Drawing Sheets

DYNAMIC CONTRAST RATIO PROCESSING METHOD AND APPARATUS OF LIQUID CRYSTAL DISPLAYING APPARATUS

TECHNICAL FIELD

The present technology relates to a dynamic contrast ratio processing method and apparatus of a liquid crystal displaying apparatus.

BACKGROUND ART

Although liquid crystal displaying apparatus and liquid crystal televisions have gradually become main products in a displaying area, effort for improving picture quality of liquid crystal display is continuous, wherein a main research focuses on how to increase contrast ratio (CR) of the liquid crystal displaying apparatus. Actually, the contrast ratio of the liquid crystal displaying apparatus is a ratio of luminance, that is, a ratio of the blackest luminance unit and the whitest luminance unit, and the brighter the white is and the darker the black is, the higher the contrast ratio is. Thus, the contrast ratio is an important parameter of the liquid crystal displaying apparatus. In case of a same luminance value, the higher the contrast ratio is, the more color layers can be displayed. At present, it is limited for the degree of increasing the contrast ratio by means of internal structures, materials, and manufacture processes of the liquid crystal displaying apparatus, and prior arts focus mainly on increasing the contrast ratio by a driving method.

Therefore, a prior art proposes a dynamic contrast ratio adjusting technique, and particularly a method for enabling the liquid crystal displaying apparatus to represent a bigger "bright-dark difference" according to a bright-dark ratio of a displayed picture. Said method differs from a method of calculating the contrast ratio according to black/white luminance of a still picture in performing a calculation by executing a luminance statistics of an input picture. For example, the prior art proposes a dynamic Gamma control (DGC) method, which firstly performs a histogram statistics on received low voltage differential signaling (LVDS) data, figures out data amounts of different gray groups, compares data amounts of respective gray groups with preset thresholds, and adjusts a luminance control parameter of a backlight source when the data amount of respective gray group varies. However, when using such a dynamic Gamma control method of the prior art, flickering phenomenon is obvious and picture quality is decreased.

SUMMARY OF THE INVENTION

The present technology provides a dynamic contrast ratio processing method and apparatus of a liquid crystal displaying apparatus, which improve the flickering phenomenon effectively and enhance the picture quality.

The dynamic contrast ratio processing method of a liquid crystal displaying apparatus in one embodiment of the invention comprises:

step 1, performing a histogram statistics processing on input data of a present frame, dividing a statistics processing result into N gray groups, and calculating a data amount corresponding to each gray group;

Step 2, comparing each data amount with a first threshold, setting gray groups whose corresponding data amounts are larger than or equal to the first threshold as gray groups with priority, and setting a gray group having the highest luminance in said gray groups with priority as a main priority gray group of the present frame; if corresponding data amount of each gray group is less than the first threshold, setting a gray group having a maximum data amount as the main priority gray group of the present frame Step 3, determining whether the luminance of the main priority gray group of the present frame is the same as that of the main priority gray group of a previous frame, and performing step 4 if it is, otherwise performing step 5;

Step 4, comparing data amounts corresponding to the main priority gray group, a high luminance gray group and a low luminance gray group of the present frame with corresponding tolerance values to determine whether it is necessary to change a luminance control parameter, and obtaining the luminance control parameter of the present frame according to the main priority gray group, the high luminance gray group and the low luminance gray group of the present frame and performing step 6, if it is necessary to change the luminance control parameter, otherwise ending the processing and maintaining the luminance control parameter of the previous frame;

Step 5, obtaining the luminance control parameter of the present frame according to the main priority gray group of the present frame;

Step 6, outputting the luminance control parameter of the present frame, and ending the processing.

In an embodiment of the present application, said step 4 may additionally comprises:

Step 41, determining whether the data amount corresponding to the main priority gray group of the present frame is less than a preset first tolerance value, and performing step 42 if it is, otherwise ending the processing;

Step 42, selecting the high luminance gray group having a luminance higher one level than the main priority gray group of the present frame and the low luminance gray group having a luminance lower one level than the main priority gray group of the present frame, comparing the data amount corresponding to said high luminance gray group with a second tolerance value, comparing the data amount corresponding to said low luminance gray group with a third tolerance value, and performing step 43 if the data amount corresponding to said high luminance gray group is larger than the second tolerance value and the data amount corresponding to said low luminance gray group is less than the third tolerance value, otherwise performing step 44;

Step 43, generating the luminance control parameter of the present frame according to the main priority gray group and the high luminance gray group of the present frame, and performing step 6;

Step 44, comparing the data amount corresponding to said high luminance gray group with a fourth tolerance value, comparing the data amount corresponding to said low luminance gray group with a fifth tolerance value, and performing step 45 if the data amount corresponding to said high luminance gray group is less than the fourth tolerance value and the data amount corresponding to said low luminance gray group is larger than the fifth tolerance value, otherwise ending the processing;

Step 45, generating the luminance control parameter of the present frame according to the main priority gray group and the low luminance gray group of the present frame, and performing step 6.

Wherein, for example, said first tolerance value is $Y_1=(1-A1)T_1$, A1 is a preset first tolerance amount, and $T_1$ is the preset first threshold; said second tolerance value is $Y_2=(1+A2)D_{G-1}$, A2 is a preset second tolerance amount, and $D_{G-1}$ is the data amount corresponding to the high luminance gray group of the previous frame; said third tolerance value is $Y_3=(1-A3)D_{G-1}$, A3 is a preset third tolerance amount, and $D_{L-1}$ is the data amount corresponding to the low luminance gray group of the previous frame; said fourth tolerance value is $Y_4=(1-A4)D_{G-1}$, A4 is a preset fourth tolerance amount; said fifth tolerance value is $Y_5=(1+A5)D_{L-1}$, A5 is a preset fifth tolerance amount.

Said step 43 for example is: generating the luminance control parameter of the present frame according to a formula $P=P_M+(P_G-P_M)/X$, wherein P is the luminance control parameter of the present frame, $P_M$ is a main luminance control parameter generated according to the main priority gray group, $P_G$ is a high luminance control parameter generated according to the high luminance gray group, and X is a preset amplitude value.

Said step 45 for example is: generating the luminance control parameter of the present frame according to a formula $P=P_M-(P_M-P_L)/X$, wherein P is the luminance control parameter of the present frame, $P_M$ is a main luminance control parameter generated according to the main priority gray group, $P_L$ is a low luminance control parameter generated according to the low luminance gray group, and X is a preset amplitude value.

The dynamic contrast ratio processing apparatus of a liquid crystal displaying apparatus in one embodiment of the present invention includes:

a statistics processing module, for receiving input data of a present frame, performing a histogram statistics processing on input data of the present frame, dividing a statistics processing result into N gray groups, and calculating a data amount corresponding to each gray group;

a first determination module connected with said statistics processing module, for comparing each data amount with a first threshold, setting gray groups whose corresponding data amounts are larger than or equal to the first threshold as gray groups with priority, and setting a gray group having the highest luminance in said gray groups with priority as a main priority gray group of the present frame; if corresponding data amount of each gray group is less than the first threshold, setting a gray group having a maximum data amount as the main priority gray group of the present frame a second determination module connected with said first determination module, for determining whether the luminance of the main priority gray group of the present frame is the same as that of the main priority gray group of a previous frame;

a first processing module connected with said second determination module, for comparing data amounts corresponding to the main priority gray group, a high luminance gray group and a low luminance gray group of the present frame with corresponding tolerance values to determine whether it is necessary to change a luminance control parameter when the luminance of the main priority gray group of the present frame is the same as that of the main priority gray group of the previous frame, and obtaining the luminance control parameter of the present frame according to the main priority gray group, the high luminance gray group and the low luminance gray group of the present frame when it is necessary to change the luminance control parameter;

a second processing module connected with said second determination module, for obtaining the luminance control parameter of the present frame according to the main priority gray group of the present frame when the luminance of the main priority gray group of the present frame is different from that of the main priority gray group of the previous frame;

a parameter output module connected with said first processing module and said second processing module respectively, for outputting the luminance control parameter of the present frame.

In an embodiment of the present application, said first processing module may additionally comprises:

a basic determination unit connected with said second determination module, for determining whether the data amount corresponding to the main priority gray group of the present frame is less than a preset first tolerance value, when the luminance of the main priority gray group of the present frame is the same as that of the main priority gray group of the previous frame;

a first determination unit connected with said basic determination unit, when the data amount corresponding to the main priority gray group of the present frame is less than the preset first tolerance value, comparing the data amount corresponding to the high luminance gray group having a luminance higher one level than the main priority gray group of the present frame with a second tolerance value, comparing the data amount corresponding to the low luminance gray group having a luminance lower one level than the main priority gray group of the present frame with a third tolerance value, and determining whether the data amount corresponding to said high luminance gray group is larger than the second tolerance value and whether the data amount corresponding to said low luminance gray group is less than the third tolerance value;

a first processing unit connected with said first determination unit, for obtaining the luminance control parameter of the present frame according to the main priority gray group and the high luminance gray group of the present frame, when the data amount corresponding to said high luminance gray group is larger than the second tolerance value and the data amount corresponding to said low luminance gray group is less than the third tolerance value;

a second determination unit connected with said first determination unit, when the data amount corresponding to said high luminance gray group is less than the second tolerance value or the data amount corresponding to said low luminance gray group is larger than the third tolerance value, comparing the data amount corresponding to said high luminance gray group with a fourth tolerance value, comparing the data amount corresponding to said low luminance gray group with a fifth tolerance value, and determining whether the data amount corresponding to said high luminance gray group is less than the fourth tolerance value and whether the data amount corresponding to said low luminance gray group is larger than the fifth tolerance value;

a second processing unit connected with said second determination unit, for obtaining the luminance control parameter of the present frame according to the main priority gray group and the low luminance gray group of the present frame, when the data amount corresponding to said high luminance gray group is less than the fourth tolerance value and the data amount corresponding to said low luminance gray group is larger than the fifth tolerance value;

a parameter output unit connected with said first processing unit and said second processing unit respectively, for transmitting the luminance control parameter of the present frame to said parameter output module.

An aspect of the present invention proposes a dynamic contrast ratio processing method and apparatus of a liquid crystal displaying apparatus, which adjust the dynamic contrast ratio slightly by setting two thresholds and corresponding tolerance values and adjust the luminance control parameter slightly according to variation condition of data amounts of gray groups neighboring the main priority gray group of the present frame when the data amount corresponding to the main priority gray group of the present frame varies, and thus improve the flickering phenomenon effectively and enhance the quality of picture.

Below, further description will be given to technical solutions of the embodiments of the present invention in more detail by the accompanying drawings and embodiments.

DESCRIPTION OF THE REFERENCE SIGNS

| | | | |
|---|---|---|---|
| 10 | statistics processing module; | 20 | first determination module; |
| 30 | second determination module; | 40 | first processing module; |
| 50 | second processing module; | 60 | parameter output module; |
| 41 | basic determination unit; | 42 | first determination unit; |
| 43 | first processing unit; | 44 | second determination unit; |
| 45 | second processing unit; | 46 | parameter output unit. |

DETAILED DESCRIPTION OF THE INVENTION

Figure 1:
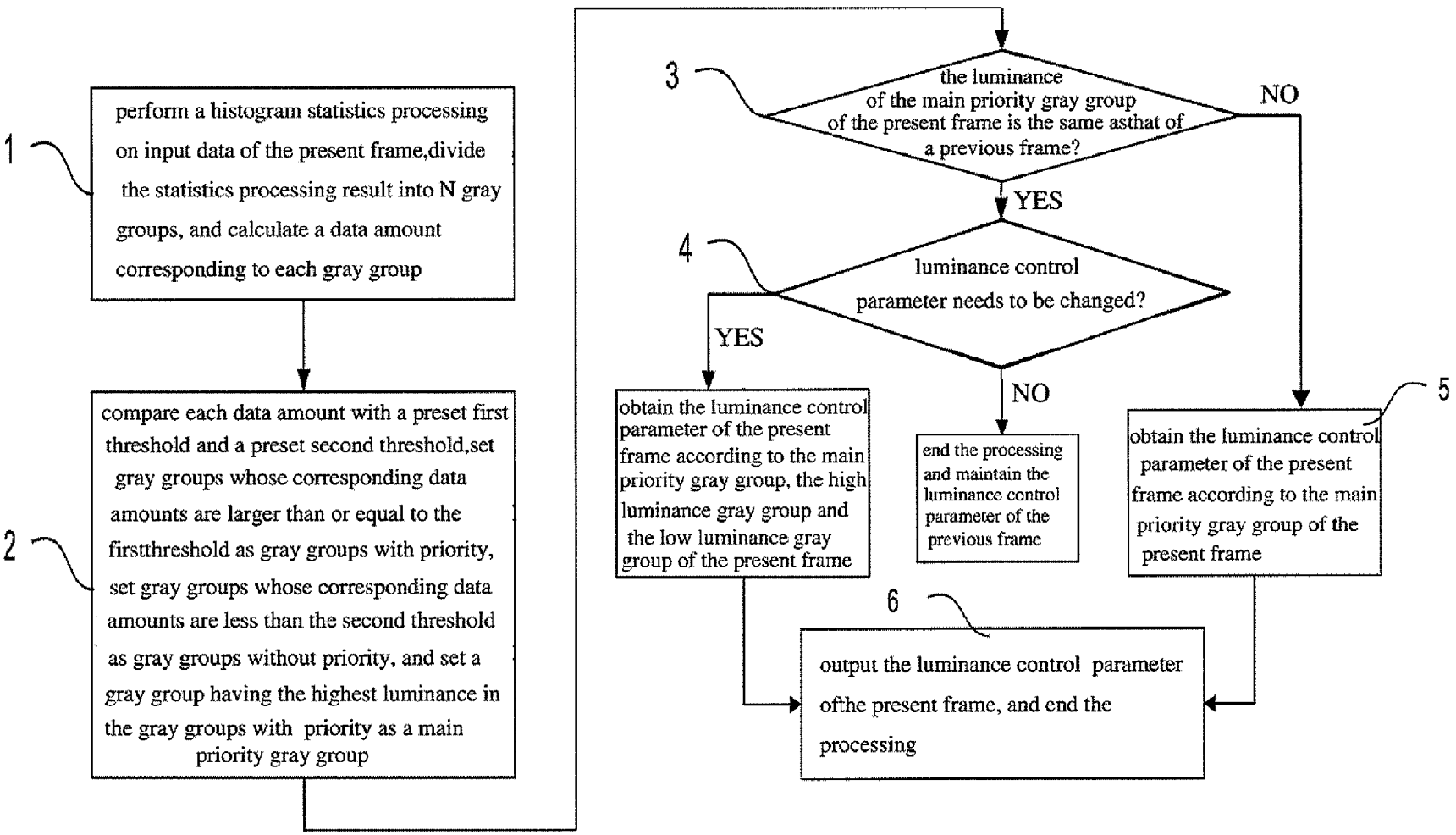
FIG. 1 is a flowchart of a dynamic contrast ratio processing method of a liquid crystal displaying apparatus according to one embodiment of the present invention.

FIG. 1 is a flowchart of a dynamic contrast ratio processing method of a liquid crystal displaying apparatus according to one embodiment of the present invention, and particularly is:

step 1, performing a histogram statistics processing on input data of a present frame, dividing a statistics processing result into N gray groups, and calculating a data amount corresponding to each gray group;

Step 2, comparing each data amount with a preset first threshold $T_1$ and a preset second threshold $T_2$, setting gray groups whose corresponding data amounts are larger than or equal to the first threshold $T_1$ as gray groups with priority, setting gray groups whose corresponding data amounts are less than the second threshold $T_2$ as gray groups without priority, and setting a gray group having the highest luminance in said gray groups with priority as a main priority gray group $B_M$; if corresponding data amount of each gray group is less than the first threshold, setting a gray group having a maximum data amount as the main priority gray group of the present frame Step 3, determining whether the luminance of the main priority gray group $B_M$ of the present frame is the same as that of the main priority gray group of a previous frame, and performing step 4 if it is, otherwise performing step 5;

Step 4, comparing data amounts corresponding to the main priority gray group $B_M$, a high luminance gray group $B_G$ and a low luminance gray group $B_L$ of the present frame with corresponding tolerance values to determine whether it is necessary to change a luminance control parameter, and obtaining the luminance control parameter of the present frame according to the main priority gray group $B_M$, the high luminance gray group $B_G$ and the low luminance gray group $B_L$ of the present frame and performing step 6, if it is necessary to change the luminance control parameter, otherwise ending the processing and maintaining the luminance control parameter of the previous frame, wherein the high luminance gray group $B_G$ is the gray group having a luminance higher one level than that of the main priority gray group $B_M$ of the present frame, and the low luminance gray group $B_L$ is the gray group having a luminance lower one level than that of the main priority gray group $B_M$ of the present frame;

Step 5, obtaining the luminance control parameter P of the present frame according to the main priority gray group $B_M$ of the present frame;

Step 6, outputting the luminance control parameter P of the present frame, and ending the processing.

The technical solution of one embodiment of the present invention adjusts the dynamic contrast ratio slightly by setting two thresholds and corresponding tolerance values, and thus improves the flickering phenomenon and enhances the picture quality. Particularly, the embodiment of the present invention firstly processes input data of the present frame by using a histogram statistics, divides grays of all pixels into N gray groups $B_1, B_2, B_3, \ldots, B_N$, and obtains data amounts $D_1, D_2, D_3, \ldots, D_N$ corresponding to every gray groups of the present frame. Then, the embodiment of the present invention compares each data amount with a preset first threshold $T_1$, sets a gray group as a gray group with priority when the corresponding data amount of the gray group is larger than or equal to the first threshold $T_1$. Optionally, the embodiment of the present invention may also compares each data amount with a preset second threshold $T_2$, which is smaller than the present first threshold T1, and sets a gray group as a gray group without priority when the corresponding data amount of the gray group is less than the second threshold $T_2$. In actual operation, "1" or "0" can be set inside a gray group to represent the priority of the gray group, for example, "1" is set inside a gray group to represent that the gray group is a gray group with priority, while "0" is set inside a gray group to represent that the gray group is a gray group without priority. After marking out the gray groups with priority, a gray group having the highest luminance in the gray groups with priority is selected as a main priority gray group $B_M$ of the present frame. If corresponding data amount of each gray group is less than the first threshold, setting a gray group having a maximum data amount as the main priority gray group of the present frame. The main priority gray group $B_M$ is given the highest priority, and a luminance control parameter of the backlight source will be generated according to the main priority gray group $B_M$. With respect to each frame of picture, there is a corresponding main priority gray group. When main priority gray groups of two consecutive frames of picture are different from each other, it means that a main luminance circumstance of the two frames of picture varies, and thus it is necessary to generate a new backlight-source luminance control parameter according to the varied main priority gray group, and change the luminance of the backlight source by using the new backlight-source luminance control parameter. The embodiment of the present invention firstly determines whether the luminance of the main priority gray group $B_M$ of the present frame is the same as that of the main priority gray group of a previous frame, when the two main priority gray groups are different which indicates that the main luminance circumstance of the two frames of picture varies, the embodiment of the present invention generates the luminance control parameter P of the present frame according to the main priority gray group $B_M$ of the present frame, and then outputs the luminance control parameter P of the present frame and ends the processing on the present frame. In the technical solution of the embodiment of the present invention, the generation of the luminance control parameter of the present frame and the control of the luminance of the backlight source can be implemented by using prior arts, for example, a dimming coefficient is determined according to a gray value of the main priority gray group $B_M$ of the present frame at first, and then the backlight-source luminance control parameter is determined according to the dimming coefficient. Since there is a one-to-one correspondence between the dimming coefficient and the backlight-source luminance control parameter, the backlight-source luminance control parameter can be obtained by searching a lookup table for the correspondence between the light adjusting coefficient and the backlight-source-luminance control parameter, once the light adjusting coefficient is determined. The backlight-source luminance control parameter is a duty ratio of the PWM Dimming signal. Thereafter, a PWM dimming control signal is generated according to the backlight-source luminance control parameter, and finally the backlight source is driven by using the PWM dimming control signal and the luminance of the backlight source is changed.

When it is determined that the luminance of the main priority gray group $B_M$ of the present frame is the same as that of the main priority gray group of the previous frame, it indicates that the main luminance circumstance of the two frames of picture does not vary. However, one embodiment of the present invention proposes a technical solution of checking the data amount variation in this case, which determines whether it is necessary to change the luminance control parameter by comparing data amounts. Particularly, the embodiment of the present invention compares the data amount corresponding to the main priority gray group $B_M$ of the present frame, the data amount corresponding to the high luminance gray group $B_G$, and the data amount corresponding to the low luminance gray group $B_L$ with corresponding tolerance values respectively to further determine whether it is necessary to change the luminance control parameter. If it is necessary to change the luminance control parameter, the embodiment of the present invention obtains the luminance control parameter of the present frame according to the main priority gray group $B_M$ and the high luminance gray group $B_G$ of the present frame, and the main priority gray group $B_M$ and the low luminance gray group $B_L$ of the present frame respectively, outputs the luminance control parameter P of the present frame, and ends the processing on the present frame; if it is unnecessary to change the luminance control parameter, then ends the processing and maintains the luminance control parameter of the previous frame.

Figure 2:
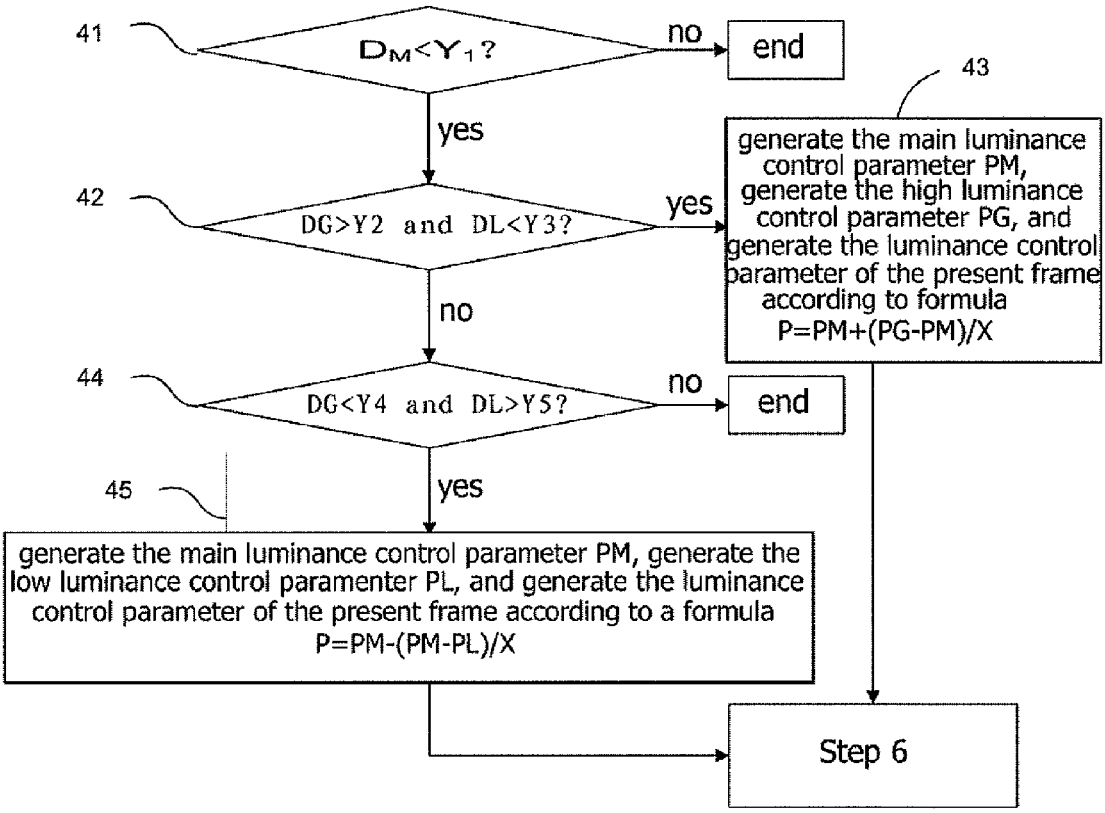
FIG. 2 is a flowchart of a processing method for determining whether it is necessary to change a luminance control parameter according to one embodiment of the present invention.

FIG. 2 is a flowchart of a processing method for determining whether it is necessary to change the luminance control parameter in one embodiment of the invention. In the technical solution shown in FIG. 1, the step 4 particularly is:

Step 41, determining whether the data amount $D_M$ corresponding to the main priority gray group $B_M$ of the present frame is less than a preset first tolerance value $Y_1$, and performing step 42 if it is, otherwise ending the processing, wherein the first tolerance value is $Y_1=(1-A1)\ T_1$, A1 is a preset first tolerance amount, $T_1$ is the preset first threshold;

Step 42, selecting the high luminance gray group $B_G$ having a luminance higher one level than that of the main priority gray group $B_M$ of the present frame and the low luminance gray group $B_L$ having a luminance lower one level than that of the main priority gray group $B_M$ of the present frame, comparing the data amount $D_G$ corresponding to the high luminance gray group $B_G$ with a second tolerance value $Y_2$, comparing the data amount $D_L$ corresponding to the low luminance gray group $B_L$ with a third tolerance value $Y_3$, and performing step 43 when $D_G>Y_2$ and $D_L<Y_3$, otherwise performing step 44, wherein, the second tolerance value is $Y_2=(1+A2)D_{G-1}$, the third tolerance value is $Y_3=(1-A3)D_{L-1}$, A2 is a preset second tolerance amount, A3 is a preset third tolerance amount, $D_{G-1}$ is the data amount corresponding to the high luminance gray group of the previous frame, $D_{L-1}$ is the data amount corresponding to the low luminance gray group of the previous frame;

Step 43, generating the main luminance control parameter $P_M$ according to the main priority gray group $B_M$ of the present frame, generating the high luminance control parameter $P_G$, according to the high luminance gray group $B_G$ of the present frame, generating the luminance control parameter P of the present frame according to a formula $P=P_M+(P_G-P_M)/X$, and performing step 6, wherein X is a preset amplitude value;

Step 44, comparing the data amount $D_G$ corresponding to the high luminance gray group $B_G$ with a fourth tolerance value $Y_4$, comparing the data amount $D_L$ corresponding to the low luminance gray group $B_L$ with a fifth tolerance value $Y_5$, and performing step 45 when $D_G<Y_4$ and $D_L>Y_5$, otherwise ending the processing, wherein the fourth tolerance value is $Y_4=(1-A4)D_{G-1}$, the fifth tolerance value is $Y_5=(1+A5)D_{L-1}$, A4 is a preset fourth tolerance amount, A5 is a preset fifth tolerance amount, $D_{G-1}$ is the data amount corresponding to the high luminance gray group of the previous frame, $D_{L-1}$ is the data amount corresponding to the low luminance gray group of the previous frame;

Step 45, generating the main luminance control parameter $P_M$ according to the main priority gray group $B_M$ of the present frame, generating the low luminance control parameter $P_L$ according to the low luminance gray group $B_L$ of the present frame, generating the luminance control parameter P of the present frame according to a formula $P=P_M-(P_M-P_L)/X$, and performing step 6, wherein X is a preset amplitude value.

Particularly, it is determined whether the data amount $D_M$ corresponding to the main priority gray group $B_M$ of the present frame is less than the preset first tolerance value $Y_1$, and the luminance control parameter may possibly be adjusted if the determination result is "YES", otherwise the luminance control parameter is not adjusted, the previous state is kept, and the operation is stopped. Wherein the preset first tolerance value is $Y_1=(1-A1)T_1$, A1 is the preset first tolerance amount, $T_1$ is the preset first threshold. It is necessary to explain herein: if the data amount $D_M$ corresponding to the main priority gray group $B_M$ is larger than the preset first tolerance value $Y_1$, it means that it is possible for the data amount $D_M$ to vary between the first tolerance value $Y_1$ and the first threshold $T_1$ or vary above the first threshold $T_1$. When the data amount $D_M$ corresponding to the main priority gray group $B_M$ varies between the first tolerance value $Y_1$ and the first threshold $T_1$, that is, $(1-A1)T_1 \le D_M \le T_1$, it indicates that the variation magnitude of the data amount $D_M$ is small, and thus the variation of the data amount $D_M$ can be omitted and the luminance control parameter does not need to be adjusted, such that a flickering phenomenon caused by the change of the luminance control parameter due to the small data amount variation can be prevented. If the data amount $D_M$ corresponding to the main priority gray group $B_M$ varies above the first threshold $T_1$, that is, $D_M>T_1$, it indicates that the luminance of the main priority gray group $B_M$ is still in an absolute advantageous state, and thus it is unnecessary to adjust the luminance control parameter either.

Figure 3:
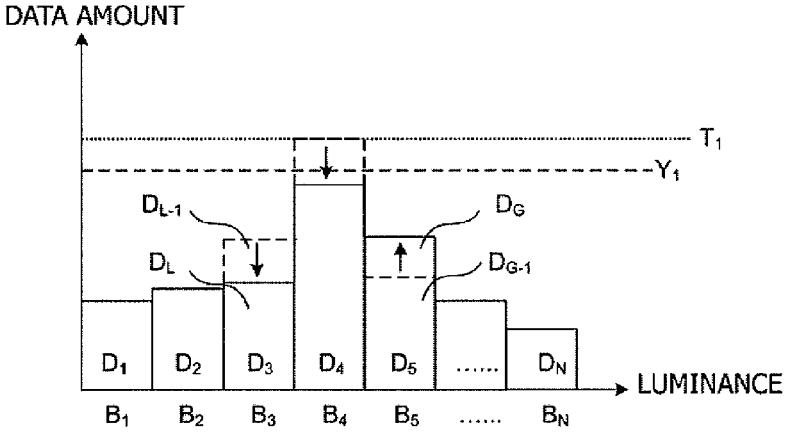
FIG. 3 is a schematic diagram of adjusting a luminance control parameter in a first case in one embodiment of the present invention; g.4 is a schematic diagram of adjusting a luminance control parameter in a second case in the embodiment of the present invention.

With respect to the case that the data amount $D_M$ corresponding to the main priority gray group $B_M$ of the present frame is less than the preset first tolerance value $Y_1$, whether to adjust the luminance control parameter is also dependent on the variation condition of the data amount of the gray groups neighboring the main priority gray group $B_M$. FIG. 3 is a schematic diagram of adjusting the luminance control parameter in a first case in an embodiment of the present invention, wherein x axis indicates gray groups $B_1$, $B_2$, $B_3$, . . . , $B_N$ having gradually increased luminance, y axis indicates the data amount $D_1$, $D_2$, $D_3$, . . . , $D_N$ corresponding to gray groups $B_1$, . . . , $B_2$, $B_3$, . . . , $B_N$ respectively. In the present embodiment, the main priority gray group $B_M$ corresponds to $B_4$, the data amount of which is $D_4$. At first, the high luminance gray group $B_G$ (corresponding to $B_5$) having a luminance higher one level than that of the main priority gray group $B_M$ is selected, the low luminance gray group $B_L$ (corresponding to $B_3$) having a luminance lower one level than that of the main priority gray group $B_M$ is selected, the data amount $D_G$ corresponding to the high luminance gray group $B_G$ (corresponding to $D_5$) is compared with a second tolerance value $Y_2$, and the data amount $D_L$ corresponding to the low luminance gray group $B_L$ (corresponding to $D_3$) is compared with a third tolerance value $Y_3$. When $D_G>Y_2$ and $D_L<Y_3$, the main luminance control parameter $P_M$ is generated according to the main priority gray group $B_M$, the high luminance control parameter $P_G$ is generated according to the high luminance gray group $B_G$, the luminance control parameter P of the present frame is generated according to a formula $P=P_M+(P_G-P_M)/X$, and at last the luminance control parameter P of the present frame is outputted and the processing on the present frame is ended. Wherein, the second tolerance value is $Y_2=(1+A2)D_{G-1}$, the third tolerance value is $Y_3=(1-A3)D_{L-1}$, A2 is a preset second tolerance amount, A3 is a preset third tolerance amount, $D_{G-1}$ is the data amount corresponding to the high luminance gray group of a previous frame, $D_{L-1}$ is the data amount corresponding to the low luminance gray group of a previous frame, and X is a preset amplitude value. In the above technical solution of the embodiment of the present invention, the second tolerance value $Y_2$ and the third tolerance value $Y_3$ are associated with the data amount of the previous frame. When the data amount $D_G$ corresponding to the high luminance gray group $B_G$ is higher than the second tolerance value $Y_2$ and the data amount $D_L$ corresponding to the low luminance gray group $B_L$ is lower than the third tolerance value $Y_3$, it indicates that the luminance of the present frame tends to have a high luminance, and thus it is necessary to increase the luminance control parameter of the present frame, and a increasing amount of the luminance control parameter is a difference between the main luminance control parameter $P_M$ and the high luminance control parameter $P_G$ divided by X.

Figure 4:
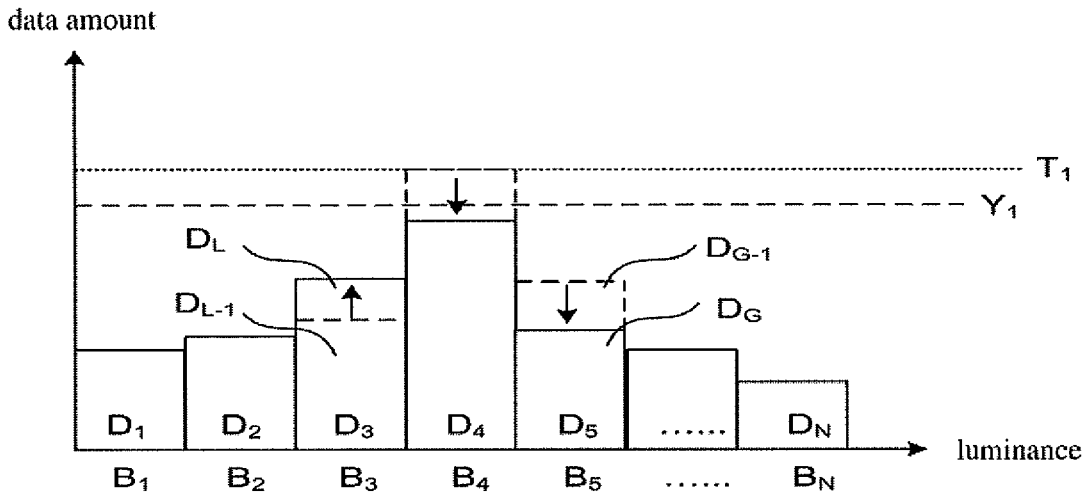

FIG. 4 is a schematic diagram for adjusting the luminance control parameter in a second case in the embodiment of the present invention. After the data amount $D_G$ corresponding to the high luminance gray group $B_G$ (corresponding to $D_5$) is compared with the second tolerance value $Y_2$ and the data amount $D_L$ corresponding to the low luminance gray group $B_L$ (corresponding to $D_3$) is compared with the third tolerance value $Y_3$, if $D_G\leq Y_2$ or $D_L\geq Y_3$, then an opposite determination is made. Particularly, the data amount $D_G$ corresponding to the high luminance gray group $B_G$ (corresponding to $D_5$) is compared with a fourth tolerance value $Y_4$ and the data amount $D_L$ corresponding to the low luminance gray group $B_L$ (corresponding to $D_3$) is compared with a fifth tolerance value $Y_5$. When $D_G<Y_4$ and $D_1>Y_5$, the main luminance control parameter $P_M$ is generated according to the main priority gray group $B_M$, the low luminance control parameter $P_L$ is generated according to the low luminance gray group $B_L$, the luminance control parameter P of the present frame is generated according to a formula $P=P_M-(P_M-P_L)/X$, and at last the luminance control parameter P of the present frame is outputted and the processing of the frame is ended; otherwise, the luminance control parameter is not adjusted and a previous state is kept, and the operation is ended. Wherein, the fourth tolerance value is $Y_4=(1-A4)D_{G-1}$, the fifth tolerance value is $Y_5=(1+A5)D_{L-1}$, A4 is a preset fourth tolerance amount. A5 is a preset fifth tolerance amount, $D_{G-1}$ is the data amount corresponding to the high luminance gray group of a previous frame, $D_{L-1}$ is the data amount corresponding to the low luminance gray group of a previous frame, and X is a preset amplitude value. In the present step, the fourth tolerance value $Y_4$ and the fifth tolerance value $Y_5$ are associated with the data amount of the previous frame. When the data amount $D_G$ corresponding to the high luminance gray group $B_G$ is lower than the fourth tolerance value $Y_4$ and the data amount $D_L$ corresponding to the low luminance gray group $B_L$ is higher than the fifth tolerance value $Y_5$, it indicates that the luminance of the present frame tends to have a low luminance, and thus it is necessary to decrease the luminance control parameter of the present frame, and a decreasing amount of the luminance control parameter is a difference between the main luminance control parameter $P_M$ and the low luminance control parameter $P_L$ divided by X.

In the above technical solution, the corresponding parameters and the preset amplitude value X can be adjusted based on the condition of the liquid crystal panel. For example, taking a liquid crystal of 1440×900 as an example, the first threshold $T_1$ can be set to 5000~7000, the second threshold $T_2$ can be set to 1000, the preset first tolerance amount A1 can be set to $(T_1-T_2)/(2\times T_1)$ which makes the preset first tolerance value $Y_1$ is about $(T_1+T_2)/2$, the preset second tolerance amount A2, third tolerance amount A3, fourth tolerance amount A4 and fifth tolerance amount A5 range within 0.2-0.3, that is, the second tolerance value $Y_2=(1.2\sim1.3)D_{G-1}$, the third tolerance value $Y_3=(0.7\sim0.8)D_{L-1}$, the fourth tolerance value $Y_4=(0.7\sim0.8)D_{G-1}$ and the fifth tolerance value $Y_2=(1.2\sim1.3)D_{L-1}$, and the preset amplitude value X can be set to 2~3. In a practical application, the second tolerance amount A2, the third tolerance amount A3, the fourth tolerance amount A4 and the fifth tolerance amount A5 can be set to be equal to each other.

It can be seen from the above technical solution of the embodiment of the present invention that when the data amount of the main priority gray group of the present frame varies, the embodiment of the present invention adjusts the luminance control parameter slightly based on the variation condition of the data amounts of the gray groups neighboring the main priority gray group of the present frame, such that the flickering phenomenon is improved efficiently and the picture quality is enhanced.

Figure 5:
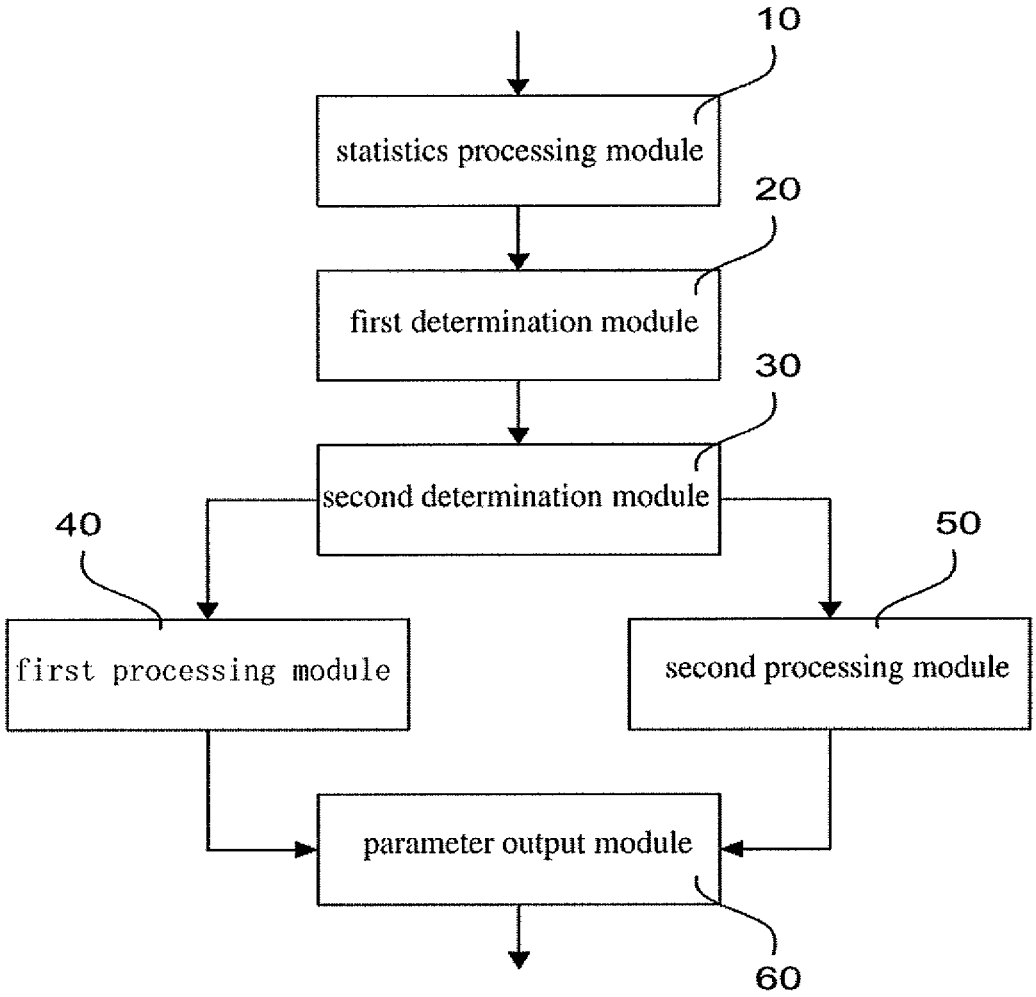
FIG. 5 is a structural schematic diagram of a dynamic contrast ratio processing apparatus of a liquid crystal displaying apparatus according to one embodiment of the present invention.

FIG. 5 is a structural schematic diagram of a dynamic contrast ratio processing apparatus of a liquid crystal displaying apparatus according to one embodiment of the present invention. As shown in FIG. 5, the dynamic contrast ratio processing apparatus of the liquid crystal displaying apparatus comprises: a statistics processing module 10, for receiving input data of the present frame, performing a histogram statistics processing on the input data, dividing a result of the statistics processing into N gray groups $B_1$, $B_2$, . . . , $B_N$, and calculating the data amount $D_1, D_2, \ldots, D_N$ corresponding to the gray groups $B_1, B_2, \ldots, B_N$, respectively; a first determination module 20, connected with the statistics processing module 10, for comparing each data amount with a first threshold $T_1$, setting gray groups whose corresponding data amounts are larger than or equal to the first threshold $T_1$ as gray groups with priority, and setting a gray group having the highest luminance in the gray groups with priority as a main priority gray group $B_M$ of the present frame; if corresponding data amount of each gray group is less than the first threshold, the first determination module 20 for setting a gray group having a maximum data amount as the main priority gray group of the present frame (optionally, the first determination module 20 may also compares each data amount with a preset second threshold $T_2$, which is smaller than the present first threshold T1, and setting gray groups whose corresponding data amounts are less than the second threshold $T_2$ as gray groups without priority); a second determination module 30, connected with the first determination module 20, for determining whether the luminance of the main priority gray group $B_M$ of the present frame is the same as that of the luminance of a previous frame; a first processing module 40, connected with the second determination module 30, for comparing the data amounts corresponding to the main priority gray group, the high luminance gray group, and the low luminance gray group of the present frame with corresponding tolerance values to determine whether it is necessary to change the luminance control parameter, when the luminance of the main priority gray group $B_M$ of the present frame is the same as that of the main priority gray group of the previous frame, and obtaining a luminance control parameter of the present frame according to the main priority gray group, the high luminance gray group and the low luminance gray group of the present frame when it is necessary to change the luminance control parameter; a second processing module 50, connected with the second determination module 30, for obtaining the luminance control parameter of the present frame according to the main priority gray group $B_M$ of the present frame when the luminance of the main priority gray group of the present frame is different from that of the main priority gray group of the previous frame; a parameter output module 60, connected with the first processing module 40 and the second processing module 50 respectively, for outputting the luminance control parameter P of the present frame.

The above technical solution of the embodiment of the present invention is an implementation apparatus for the dynamic contrast ratio processing method of the liquid crystal displaying apparatus according to the embodiment of the present invention shown in FIG. 1, which adjusts the dynamic contrast ratio slightly by setting two thresholds and corresponding tolerance values, and thus improves the flickering phenomenon efficiently and enhances the picture quality. The detail operation procedure of the dynamic contrast ratio processing apparatus of the liquid crystal displaying apparatus according to the embodiment of the present invention has been described in detail, and the repeated description is omitted herein.

Figure 6:
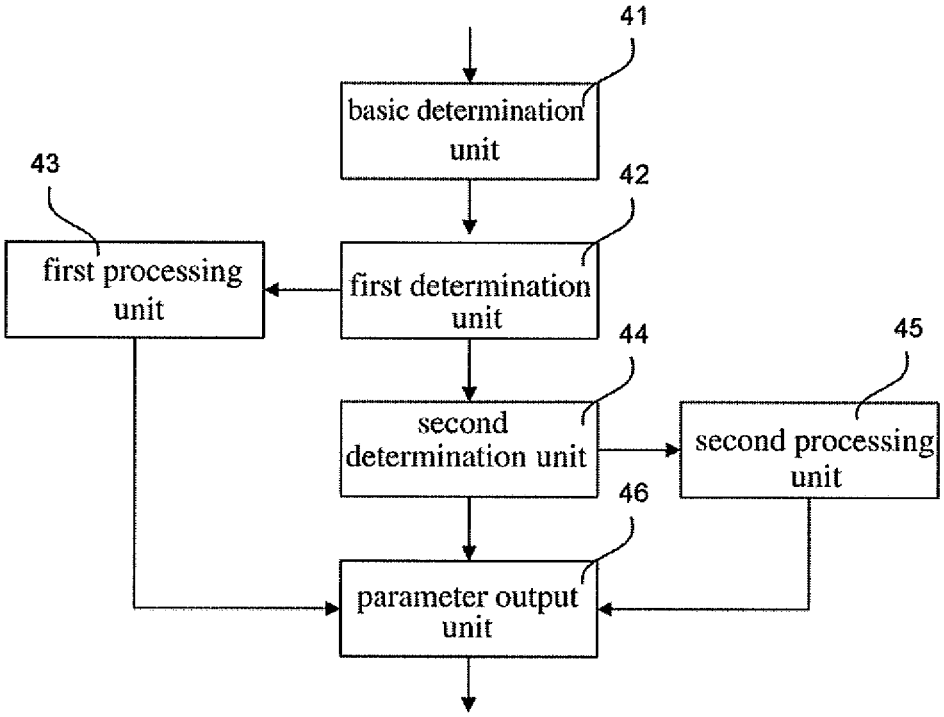
FIG. 6 is a structural schematic diagram of a first processing module of a dynamic contrast ratio processing apparatus of a liquid crystal displaying apparatus according to one embodiment of the present invention.

FIG. 6 is a structural schematic diagram of the first processing module of the dynamic contrast ratio processing apparatus of the liquid crystal displaying apparatus according to one embodiment of the present invention. As shown in FIG. 6, the first processing module comprises: a basic determination unit 41, connected with the second determination module 30, for determining whether the data amount $D_M$ corresponding to the main priority gray group $B_M$ of the present frame is less than a preset first tolerance value $Y_1$ when the luminance of the main priority gray group of the present frame is the same as that of the main priority gray group of the previous frame; a first determination unit 42, connected with the basic determination unit 41, for comparing the data amount $D_G$ corresponding to the high luminance gray group $B_G$ having a luminance higher one level than that of the main priority gray group $B_M$ of the present frame with a second tolerance value $Y_2$, comparing the data amount $D_L$ corresponding to the low luminance gray group $B_L$ having a luminance lower one level than that of the main priority gray group $B_M$ of the present frame with a third tolerance value $Y_3$, and determining whether the data amount $D_G$ corresponding to the high luminance gray group $B_G$ is larger than the second tolerance value $Y_2$ and whether the data amount $D_L$ corresponding to the low luminance gray group $B_L$ is less than the third tolerance value $Y_3$, when the data amount $D_M$ corresponding to the main priority gray group $B_M$ of the present frame is less than the preset first tolerance value $Y_1$; a first processing unit 43, connected with the first determination unit 42, for obtaining the luminance control parameter of the present frame according to the main priority gray group $B_M$ and the high luminance gray group $B_G$ of the present frame, when the data amount $D_G$ corresponding to the high luminance gray group $B_G$ is larger than the second tolerance value $Y_2$ and the data amount $D_L$ corresponding to the low luminance gray group $B_L$ is less than the third tolerance value $Y_3$; a second determination unit 44, connected with the first determination unit 42, for comparing the data amount $D_G$ corresponding to the high luminance gray group $B_G$ with a fourth tolerance value $Y_4$, comparing the data amount $D_L$ corresponding to the low luminance gray group $B_L$ with a fifth tolerance value $Y_5$, and determining whether the data amount $D_G$ corresponding to the high luminance gray group $B_G$ is less than the fourth tolerance value $Y_4$ and whether the data amount $D_L$ corresponding to the low luminance gray group $B_L$ is larger than the fifth tolerance value $Y_5$, when the data amount $D_G$ corresponding to the high luminance gray group $B_G$ is less than the second tolerance value $Y_2$ and the data amount $D_L$ corresponding to the low luminance gray group $B_L$ is larger than the third tolerance value $Y_3$; a second processing unit 45, connected with the second determination unit 43, for obtaining the luminance control parameter P of the present frame according to the main priority gray group $B_M$ and the low luminance gray group $B_L$ of the present frame, when the data amount $D_G$ corresponding to the high luminance gray group $B_G$ is less than the fourth tolerance value $Y_4$ and the data amount $D_L$ corresponding to the low luminance gray group $B_L$ is larger than the fifth tolerance value $Y_5$; and a parameter output unit 46, connected with the first processing unit 43 and the second processing unit 45 respectively, for transmitting the luminance control parameter P of the present frame to the parameter output module 60.

The first processing module of the embodiment of the present invention is an implementation apparatus of the processing method for determining whether it is necessary to change the luminance control parameter according to the embodiment of the present invention shown in FIG. 2. When the data amount of the main priority gray group of the present frame varies, the embodiment of the present invention adjusts the luminance control parameter slightly according to the variation condition of the data amount of the gray groups neighboring the main priority gray group of the present frame, such that the flickering phenomenon is improved efficiently and the picture quality is enhanced. The particular operation procedure of the first processing module of the embodiment of the present invention has been described above in detail, and the repeated description is omitted herein.

At last, it should be explained that: the above embodiments are merely used to illustrate the technical solutions of the embodiments of the present invention, but not to limit the present invention. Although the present invention has been described in detail with reference to the embodiments, those skilled in the art should understand that modifications and equivalent alternations can be made to the technical solution of the present invention without departing from the sprit and scope thereof.

The invention claimed is:

1. A dynamic contrast ratio processing method of a liquid crystal displaying apparatus, comprising:

step 1, by a statistics processing module, performing a histogram statistics processing on input data of a present frame, dividing a statistics processing result into N gray groups, and calculating a data amount corresponding to each gray group;

Step 2, by a first determination module, comparing each data amount with a first threshold, setting gray groups whose corresponding data amounts are larger than or equal to the first threshold as gray groups with priority, and setting a gray group having the highest luminance in said gray groups with priority as a main priority gray group of the present frame; if corresponding data amount of each gray group is less than the first threshold, setting a gray group having a maximum data amount as the main priority gray group of the present frame;

Step 3, by a second determination module, determining whether the luminance of the main priority gray group of the present frame is the same as that of the main priority gray group of a previous frame, and performing step 4 if it is, otherwise performing step 5;

Step 4, by a first possessing module, comparing data amounts corresponding to the main priority gray group of the present frame, a high luminance gray group having a luminance higher only one level than that of the main priority gray group of the present frame and a low luminance gray group having a luminance lower only one level than that of the main priority gray group of the present frame with corresponding tolerance values to determine whether it is necessary to change a luminance control parameter, and obtaining the luminance control parameter of the present frame according to the main priority gray group, the high luminance gray group and the low luminance gray group of the present frame and performing step 6, if it is necessary to change the luminance control parameter, otherwise ending the processing and maintaining the luminance control parameter of the previous frame;

Step 5, by a second processing module, obtaining the luminance control parameter of the present frame according to the main priority gray group of the present frame;

Step 6, by a parameter output module, outputting the luminance control parameter of the present frame, and ending the processing.

2. The dynamic contrast ratio processing method of a liquid crystal displaying apparatus according to claim 1, wherein the step 4 comprises:

Step 41, by a basic determination unit, determining whether the data amount corresponding to the main priority gray group of the present frame is less than a preset first tolerance value, and performing step 42 if it is, otherwise ending the processing;

Step 42, by a first determination unit, comparing the data amount corresponding to said high luminance gray group with a second tolerance value, comparing the data amount corresponding to said low luminance gray group with a third tolerance value, and performing step 43 if the data amount corresponding to said high luminance gray group is larger than the second tolerance value and the data amount corresponding to said low luminance gray group is less than the third tolerance value, otherwise performing step 44;

Step 43, by a first processing unit, generating the luminance control parameter of the present frame according to the main priority gray group and the high luminance gray group of the present frame, and performing step 6;

Step 44, by a second determination unit, comparing the data amount corresponding to said high luminance gray group with a fourth tolerance value, comparing the data amount corresponding to said low luminance gray group with a fifth tolerance value, and performing step 45 if the data amount corresponding to said high luminance gray group is less than the fourth tolerance value and the data amount corresponding to said low luminance gray group is larger than the fifth tolerance value, otherwise ending the processing;

Step 45, by a second processing unit, generating the luminance control parameter of the present frame according to the main priority gray group and the low luminance gray group of the present frame, and performing step 6.

3. The dynamic contrast ratio processing method of a liquid crystal displaying apparatus according to claim 2, wherein said second tolerance value is $Y_2=(1+A2)D_{G-1}$, A2 is a preset second tolerance amount, and $D_{G-1}$ is the data amount corresponding to the high luminance gray group of the previous frame.

4. The dynamic contrast ratio processing method of a liquid crystal displaying apparatus according to claim 2, wherein said third tolerance value is $Y_3=(1-A3)D_{L-1}$, A3 is a preset third tolerance amount, and $D_{L-1}$ is the data amount corresponding to the low luminance gray group of the previous frame.

5. The dynamic contrast ratio processing method of a liquid crystal displaying apparatus according to claim 2, wherein said fourth tolerance value is $Y_4=(1-A4)D_{G-1}$, A4 is a preset fourth tolerance amount, and $D_{G-1}$ is the data amount corresponding to the high luminance gray group of the previous frame.

6. The dynamic contrast ratio processing method of a liquid crystal displaying apparatus according to claim 2, wherein said fifth tolerance value is $Y_5=(1+A5)D_{L-1}$, A5 is a preset fifth tolerance amount, and $D_{L-1}$ is the data amount corresponding to the low luminance gray group of the previous frame.

7. The dynamic contrast ratio processing method of a liquid crystal displaying apparatus according to claim 2, wherein said step 43 comprises: by the first processing unit, generating the luminance control parameter of the present frame according to a formula $P=P_M+(P_G-P_M)/X$, wherein P is the luminance control parameter of the present frame, $P_M$ is a main luminance control parameter generated according to the main priority gray group, $P_G$ is a high luminance control parameter generated according to the high luminance gray group, and X is a preset amplitude value.

8. The dynamic contrast ratio processing method of a liquid crystal displaying apparatus according to claim 2, wherein said step 45 comprises: by the second processing unit, generating the luminance control parameter of the present frame according to a formula $P=P_M-(P_M-P_L)/X$, wherein P is the luminance control parameter of the present frame, $P_M$ is a main luminance control parameter generated according to the main priority gray group, $P_L$ is a low luminance control parameter generated according to the low luminance gray group, and X is a preset amplitude value.

9. The dynamic contrast ratio processing method of a liquid crystal displaying apparatus according to claim 2, wherein said first tolerance value is $Y_1=(1-A1)T_1$, A1 is a preset first tolerance amount, and $T_1$ is the preset first threshold.

10. A dynamic contrast ratio processing apparatus of a liquid crystal displaying apparatus, comprising:

a statistics processing module, for receiving input data of a present frame, performing a histogram statistics processing on input data of the present frame, dividing a statistics processing result into N gray groups, and calculating a data amount corresponding to each gray group;

a first determination module connected with said statistics processing module, for comparing each data amount with a first threshold, setting gray groups whose corresponding data amounts are larger than or equal to the first threshold as gray groups with priority, and setting a gray group having the highest luminance in said gray groups with priority as a main priority gray group of the present frame; if corresponding data amount of each gray group is less than the first threshold, for setting a gray group having a maximum data amount as the main priority gray group of the present frame;

a second determination module connected with said first determination module, for determining whether the luminance of the main priority gray group of the present frame is the same as that of the main priority gray group of a previous frame;

a first processing module connected with said second determination module, for comparing data amounts corresponding to the main priority gray group of the present frame, a high luminance gray group having a luminance higher only one level than that of the main priority gray group of the present frame and a low luminance gray group having a luminance lower only one level than that of the main priority gray group of the present frame with corresponding tolerance values to determine whether it is necessary to change a luminance control parameter when the luminance of the main priority gray group of the present frame is the same as that of the main priority gray group of the previous frame, and obtaining the luminance control parameter of the present frame according to the main priority gray group, the high luminance gray group and the low luminance gray group of the present frame when it is necessary to change the luminance control parameter;

a second processing module connected with said second determination module, for obtaining the luminance control parameter of the present frame according to the main priority gray group of the present frame when the luminance of the main priority gray group of the present frame is different from that of the main priority gray group of the previous frame;

a parameter output module connected with said first processing module and said second processing module respectively, for outputting the luminance control parameter of the present frame.

11. The dynamic contrast ratio processing apparatus of a liquid crystal displaying apparatus according to claim 10, wherein said first processing module comprises:

a basic determination unit connected with said second determination module, for determining whether the data amount corresponding to the main priority gray group of the present frame is less than a preset first tolerance value, when the luminance of the main priority gray group of the present frame is the same as that of the main priority gray group of the previous frame;

a first determination unit connected with said basic determination unit, when the data amount corresponding to the main priority gray group of the present frame is less than the preset first tolerance value, comparing the data amount corresponding to the high luminance gray group with a second tolerance value, comparing the data amount corresponding to the low luminance gray group with a third tolerance value, and determining whether the data amount corresponding to said high luminance gray group is larger than the second tolerance value and whether the data amount corresponding to said low luminance gray group is less than the third tolerance value;

a first processing unit connected with said first determination unit, for obtaining the luminance control parameter of the present frame according to the main priority gray group and the high luminance gray group of the present frame, when the data amount corresponding to said high luminance gray group is larger than the second tolerance value and the data amount corresponding to said low luminance gray group is less than the third tolerance value;

a second determination unit connected with said first determination unit, when the data amount corresponding to said high luminance gray group is less than the second tolerance value or the data amount corresponding to said low luminance gray group is larger than the third tolerance value, comparing the data amount corresponding to said high luminance gray group with a fourth tolerance value, comparing the data amount corresponding to said low luminance gray group with a fifth tolerance value, and determining whether the data amount corresponding to said high luminance gray group is less than the fourth tolerance value and whether the data amount corresponding to said low luminance gray group is larger than the fifth tolerance value;

a second processing unit connected with said second determination unit, for obtaining the luminance control parameter of the present frame according to the main priority gray group and the low luminance gray group of the present frame, when the data amount corresponding to said high luminance gray group is less than the fourth tolerance value and the data amount corresponding to said low luminance gray group is larger than the fifth tolerance value;

a parameter output unit connected with said first processing unit and said second processing unit respectively, for transmitting the luminance control parameter of the present frame to said parameter output module.

* * * * *